United States Patent [19]

Michelet et al.

[11] 4,123,045

[45] Oct. 31, 1978

[54] CRUCIBLE FOR INDUCTION HEATING APPARATUS

[75] Inventors: Jacques Michelet, Metz; Hugues Zanetta, St-Julien-les-Metz, both of France

[73] Assignee: Institut de Recherches de la Siderurgie Francaise, Saint-Germain-en-Laye, France

[21] Appl. No.: 839,317

[22] Filed: Oct. 4, 1977

[30] Foreign Application Priority Data

Oct. 4, 1976 [FR] France ..... 76 29996

[51] Int. Cl.[2] ..... F27B 14/06

[52] U.S. Cl. ..... 266/275; 13/27

[58] Field of Search ..... 13/26, 27, 32, 35; 266/242, 275, 276; 432/156–158, 262–265

[56] References Cited

U.S. PATENT DOCUMENTS 3,696,223 10/1972 Metcalf et al. ..... 13/27

*Primary Examiner*—Gerald A. Dost

*Attorney, Agent, or Firm*—Michael J. Striker

[57] ABSTRACT

A crucible for an induction heating apparatus has a base pan and a collar between which lies a refractory lining. Respective lower and upper mounting rings secured to the base pan and the collar are vertically interconnected by an annular array of non-round-section tierods that are tubular so a coolant can be passed through them. These tierods further have angularly juxtaposed sides which define spaces of outwardly decreasing angular width. Wedge-shaped blocks of refractory and electrically insulating material tightly fit between the sides of the rods and are of outwardly decreasing angular width. Inside these blocks the crucible is lined with further layers of refractory material.

10 Claims, 3 Drawing Figures

CRUCIBLE FOR INDUCTION HEATING APPARATUS

BACKGROUND OF THE INVENTION

The present invention relates to a metallurgical induction heating apparatus. More particularly this invention concerns a crubible for an induction heating apparatus.

An induction heating apparatus has a crucible that is lined with refractory material and that is externally surrounded by a heavy-duty electric coil. Metal or metal alloy to be melted is loaded into the crucible and alternating current is passed through the coil so that a moving electromagnetic field is formed with the crucible. Thus eddy currents are generated in the metal to be melted so that the metal heats up and eventually melts.

A considerable problem in such installations is that it is necessary to heat the metal contained in the crucible without heating the crucible itself. Thus when a standard crucible constituted as a large metallic vessel lined with refractory material is used it becomes very difficult to limit the heating effect to the metallic structure of the crucible. By using a very low frequency, between 1 and 5 Herz, it is possible to limit the electromagnetic heating of the crucible, while augmenting the heating of the metal by means of another heating means such as a direct electric arc or the like. Thus in such a situation the low-frequency field serves mainly to mix and circulate the metal in the crucible.

It is, however, much more desirable to use standard-frequency electrical energy at 50 or even 60 Herz. The heating effect in the crucible can be greatly reduced by forming the crucible of a multiplicity of separate wall elements separated by mortar-like webs of insulating material. Such a system can be used without auxiliary heating and without excessive heating of the crucible. Such an arrangement does, however, have the disadvantage that the crucible is extremely expensive and leak-prone.

It is also known, as for example shown in French Pat. No. 1,509,043 to form the crucible, at least in the region of the coil, of a multiplicity of separate non-magnetic metallic plates. Once again refractory cement is injected between these plates to hold the assembly together. Similar arrangements can be found in the crucible described in the French Pat. No. 1,534,905. Nevertheless crucibles of such type, on account of their compact metallic structure, have a relative short service life because of excessive heating when used above frequencies of 60 Herz.

French Pat. No. 2,100,553 shows several induction heating arrangements. One of these shows a crucible comprising an upper collar and a lower base pan. The collar and base pan are provided with outwardly projecting mounting rings that are vertically interconnected by a plurality of vertically extending tierods. These tierods are electrically insulated from each other and from the mounting rings so that they form an open circuit. Such an arrangement appears to have a better mechanical behaviour than the afore-mentioned ones. However, its technology makes difficult to change eventually defective or worn parts. Moreover, the presence, in some cases, of continuous metallic elements surrounding the refractory line can cause heating by eddy currents when the used inductive coil has the same axis as the one of the crucible, as it is usually the case.

SUMMARY OF THE INVENTION

It is therefore an object of the present invention to provide an improved induction heating apparatus.

Another object is to provide a removable crucible usable in such an apparatus.

Yet another object is to provide such a crucible which overcomes the above-given disadvantages, that is which can be used with a relatively powerful electromagnetic field at relatively high frequencies without excessive heating of its metallic parts.

Another object is to provide such a crucible wherein the lining is securely held and wherein leakage is almost entirely impossible.

These objects are attained according to the present invention in a crucible of the above-described general type, having an internal refractory line maintained by a metallic structure comprising an upper collar and a lower pan secured together by vertically extending tierods. According to the present invention, however, the tierods are of non-round section and have angularly juxtaposed sides defining vertically extending spaces of outwardly decreasing angular width. Wedge-shaped blocks of refractory and electrically insulating material tightly fit between the sides of the rods and are of outwardly decreasing angular width. Thus outward pressure on these block wedges them tightly between the rods, and pushing of the blocks outwardly between the rods is virtually impossible.

According to further features of this invention the rods are generally trapezoidal in cross-section and each have a long base turned outwardly and a short base turned inwardly.

Thus in accordance with the present invention the sides of the crucible, at least in the region of the coil, are subdivided into vertically or longitudinally extending separate conductive elements constituted by the tierods and separated by non-conducting elements constituted by the wedge blocks. Furthermore the structure in accordance with this invention is effectively a mechanically very rigid cage which insures extremely good strength of the assembly and makes it virtually impossible for an aperture to open through which liquid metal could pass. Since there is no part of the crucible which extends horizontally or perpendicular to the axis of the crucible which is also conductive, heating of the crucible is at a bear minimum.

According to another feature of this invention the tierods are tubular. This feature gives several advantages over the normally solid-section tierods. First of all the tubular construction allows a coolant such as air to be circulated longitudinally through the tierods so that heat in them can be carried off. What is more it allows the Foucault currents responsible for the skin heating effect to be minimized, as the maximum thickness of each tierod at any given point can be reduced to a minimum. Finally it has been found that using cold-drawn tubing instead of normally rolled or hot-worked rods does not in any manner reduce the overall strength of the assembly, as such cold-drawn tubing is of substantially the same tensile strength as hot-rolled solid-section rods. Furthermore, it is possible to use standard trapezoidal-section stainless-steel rods which are readily available. All that is necessary is to machine the ends so that they can be fitted to the respective mounting rings.

The novel features which are considered as characteristic for the invention are set forth in particular in the appended claims. The invention itself, however, both as to its construction and its method of operation, together with additional objects and advantages thereof, will be best understood from the following description of a specific embodiment when read in connection with the accompanying drawings.

DESCRIPTION OF A PREFERRED EMBODIMENT

Figure 1:
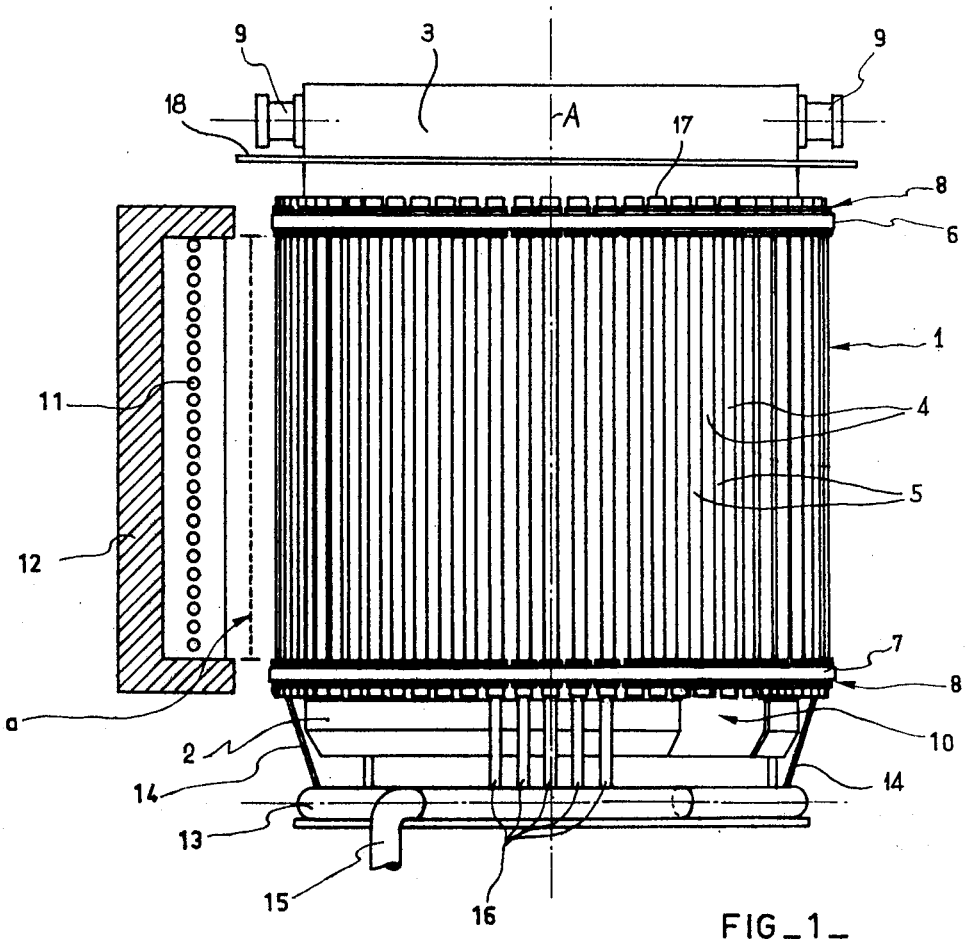
FIG. 1 is a side view of a crucible according to this invention showing the heating coil partly in section.

As shown in FIG. 1 a crucible 1 is of generally cylindrical shape and has a base pan 2 and at its upper end a collar 3. Tubular stainless-steel tierods 4 spaced angularly apart by insulating blocks 5 interconnect a mounting ring 6 fixed to the collar 3 and an identical mounting ring 7 fixed to the base pan 2, with securing means in the form of nuts 8 holding the tierods 4 tightly vertically in place. The collar 3 is also provided with gudgeons 9 for the handling of the crucible 1. The entire assembly is upwardly cylindrical and centered on a vertical axis A.

The base pan 2 has a slide valve 10 allowing tapping of a melt within the crucible. Induction heating means are schematically represented on the left side of FIG. 1. They consist in a coil 11 surrounding the crucible and placed in an annular ferromagnetic housing 12.

As shown, the height of the coil does not exceed the one of the tierods, in such way that the collar 3, the base pan 2 and their respective rings 6 and 7 are positioned out of the induction heating zone, referenced *a* in the FIG. 1.

The whole metallic structure of the crucible is preferably made of non-magnetic materials, for example of amagnetic stainless steel, in order to avoid any concentration of the magnetic field detrimental to the metallic charge contained to the crucible.

A manifold 13 is hung below the base pan 2 by means of struts or straps 14 and is connected via a pressurized feed conduit 15 to a blower. In addition short connecting conduits 16 extend between this annular manifold 13 and the lower ends of the tubular tierods 4. Thus the blower will force relatively cool ambient air upwardly through the tierods 4 so that this air exits from the upper exposed end 17 thereof.

It is, of course, possible to provide the manifold 13 at the upper end of the rods 5, in which case the flow of coolant will be downwardly out through the bottom ends thereof.

The collar 3 is also provided with an outwardly extending flange 18 adapted to rest on the upper rim of the induction heating apparatus having the coil 11 in the manner described in our copending and jointly filed patent application Ser. No. 839,318, whose entire disclosure is herewith incorporated by reference.

Figure 2:
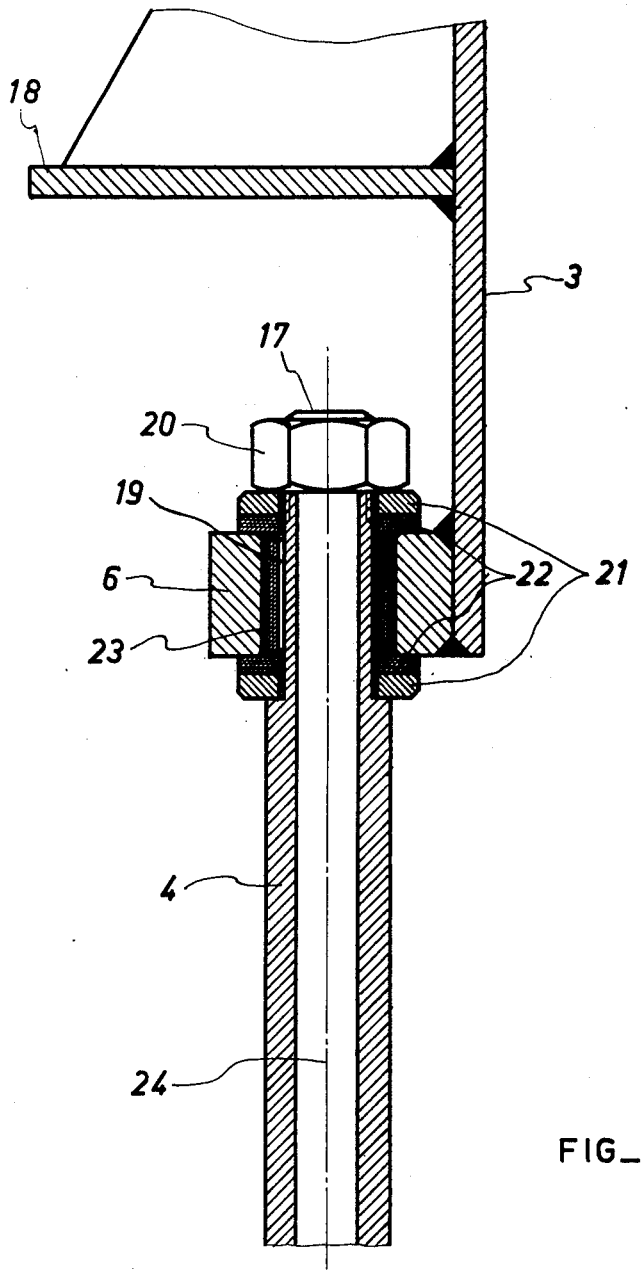
FIG. 2 is a sectional large-scale view of a detail of FIG. 1.

As better shown in FIG. 2 each of the rods 4 has its upper end machined down to cylindrical shape and is threaded so that a nut 20 can be screwed over it. To this end a pair of metal washers 21 are provided, one on a shoulder of the rod 4 and another directly underneath the nut 20. Between each of these washers 21 and the ring 6 there is provided a fiber insulating washer 22 and an insulating sleeve 23 surrounds the rod 4 where it passes through the hole 19 in the ring 6. Thus each rod 4 is fully electrically insulated from the surrounding structure. The connection at the lower end of each rod 4 is identical to that at the upper end.

Figure 3:
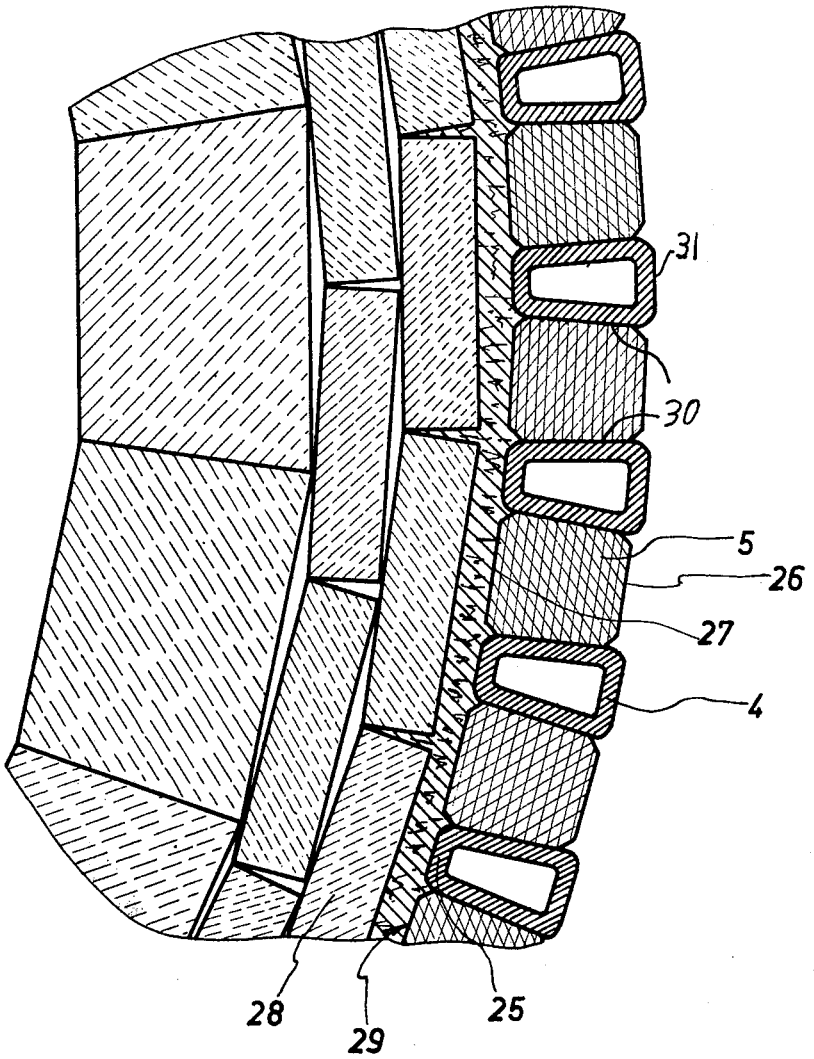
FIG. 3 is a large-scale horizontally sectional view of a detail of FIG. 1.

The insulating blocks 5 shown in horizontal section in FIG. 3 are made of electrically and thermally instituting material of good mechanical strength. They may be cast from a mixture of powdered asbestos and mineral rock sold under the tradename "Syndanio." The tubes 4 are formed in cross-section as isosceles trapezoids, having a short base 25 turned inwardly toward the axis A and each being symmetrical about a plane extending through the axis A and bisecting the short side 25. Thus spaces are formed between adjacent sides 30 which are also of trapezoidal shape, but wider toward the axis A. The long base 31 of each of the tubes 4 is turned outwardly. The blocks 5 are therefore of complementary trapezoidal shape and have short bases 26 turned outwardly and long bases 27 turned inwardly. Each of these blocks 5 is of an angular width greater than the angular width of each of the identical rods 4.

In a particular embodiment of the invention the crucible has a capacity of approximately 7 tons and a diameter of approximately 1.50 m. The short base 25 of each tubular tierod 4 is 2.5 cm wide and the long base 31 is 3.5 cm wide. Each tube 4 has a thickness measured radially of 5.5 cm so that each side 30 measured parallel to its surface is slightly longer than this dimension. The thickness of the material forming the tubes 4 is 0.8 cm and they are constituted, as mentioned above, of non-magnetic stainless steel. Since the depth penetration in such metal at a standard frequency of 50 Herz or 60 Herz is 6 cm the heating of such tubes 4 is minimal.

As also shown in FIG. 3 the interior surfaces of the outer cylinder formed by the long bases 27 of the blocks 5 and the short bases 25 of the tubes 4 is plastered with a layer 29 of mortar-like material formed basically of asbestos. Over this several layers of standard insulating refractory bricks 28 are provided as is well known in the art. Such an arrangement insures extreme stability since outward force on the blocks 5 will only wedge them more tightly between the rods 4. Similarly when it is necessary to reline the crucible the rods 4 need not be removed, the blocks 5 need merely be pushed radially inwardly to free them.

Although the invention described above shows tubes 4 having flat sides 30, these sides need not be perfectly flat and planar, so long as the space defined between them is of decreasing annular width away from the axis. Similarly, the crucible need not be of cylindrical shape, but could be of any other inwardly concave or even partially flat shape.

It will be understood that each of the elements described above, or two or more together, may also find a useful application in other types of structures differing from the types described above.

While the invention has been illustrated and described as embodied in an induction-heating crucible, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A crucible having an internal refractory line maintained by a metallic structure consisting of:
   - a base pan;
   - a collar spaced above said base pan;
   - respective lower and upper mounting rings secured to said base pan and said collar;
   - an annular array of non-round-section tierods extending vertically between said rings and having angularly juxtaposed sides defining spaces of outwardly decreasing angular width;
   - means for securing said rods to said rings and
   - wedge-shaped blocks of refractory and electrically insulating material tightly fitting between said sides of said rods and of outwardly decreasing angular width, whereby outward pressure on said blocks wedges same tightly between said rods.

2. The crucible defined in claim 1, wherein said rods are of trapezoidal section having a long base turned outwardly and a short base turned inwardly.

3. The crucible defined in claim 1, wherein said rods are tubular, said crucible further comprising means for passing a coolant fluid through said rods.

4. The crucible defined in claim 1, wherein said array is generally cylindrical is centered on an upright axis, said sides being generally flat and each being inclined to a respective plane including said axis.

5. The crucible defined in claim 1; further comprising means for insulating said rods from said rings.

6. Induction heating apparatus for metallic materials comprising:
   - the crucible defined in claim 1, and comprising a coil surrounding said crucible at said tierods.

7. The apparatus defined in claim 6, wherein said coil has an upper end substantially at said upper mounting ring and a lower end substantially at said lower mounting ring.

8. The apparatus defined in claim 6, wherein said coil has an upper rim and said crucible has supporting flange ring extending outwardly beyond said mounting rings and restable on said rim.

9. The crucible defined in claim 1, wherein said tierods are of non-magnetic stainless steel.

10. An induction heating apparatus for metallic materials comprising:
   - a crucible including
     - metallic structure consisting of
       - a base pan,
       - a collar spaced above said base pan,
       - respective lower and upper mounting rings secured to said base pan and said collar,
       - an annular array of non-round-section tierods extending vertically between said rings and having angularly juxtaposed sides defining spaces of outwardly decreasing angular width, and
     - means for securing said rods to said rings; and
   - an internal refractory lining held by said metallic structure and formed of a plurality of wedge-shaped blocks of refractory and electrically insulating material tightly fitting between said sides of said rods and of outwardly decreasing angular width, whereby outward pressure on said blocks wedges same tightly between said rods; and
   - a coil surrounding said crucible at said rods, whereby a magnetic field can be formed in said crucible.

* * * * *